US005766416A

United States Patent [19]

Hiyoshi et al.

[11] Patent Number: 5,766,416

[45] Date of Patent: Jun. 16, 1998

[54] METHOD OF PRODUCING WATERMARK PAPER

[75] Inventors: Kin-ya Hiyoshi; Takayuki Fukuchi, both of Mishima; Tadahiro Iwasaki, Suntou-gun, all of Japan

[73] Assignee: Tokushu Paper Manufacturing Co., Ltd., Japan

[21] Appl. No.: 5,401

[22] Filed: Jan. 19, 1993

Related U.S. Application Data

[63] Continuation of Ser. No. 721,598, Jul. 29, 1991, abandoned.

[30] Foreign Application Priority Data

Dec. 14, 1989 [JP] Japan ..... 1-324765

[51] Int. Cl.[6] ..... D21F 1/44

[52] U.S. Cl. ..... 162/110; 162/314

[58] Field of Search ..... 492/37, 48; 162/110, 162/314, 313

[56] References Cited

U.S. PATENT DOCUMENTS

| | | | |
|---|---|---|---|
| 353,666 | 12/1886 | Crane | 162/110 |
| 1,514,238 | 11/1924 | Wallace . | |
| 1,571,715 | 2/1926 | Fedring | 162/110 |
| 1,616,222 | 2/1927 | Harrigon . | |
| 1,901,024 | 3/1933 | Edge | 162/110 |
| 1,901,049 | 3/1933 | Heinrich | 162/110 |
| 2,319,800 | 5/1943 | Denton | 162/110 |
| 4,526,652 | 7/1985 | Waters . | |
| 5,100,512 | 3/1992 | Waters | 162/110 |

FOREIGN PATENT DOCUMENTS

| | | | |
|---|---|---|---|
| 4921248 | 5/1974 | Japan | 162/110 |
| 373905 | 6/1932 | United Kingdom . | |
| 1447933 | 9/1976 | United Kingdom | 162/110 |
| 8605220 | 9/1986 | WIPO | 162/110 |

*Primary Examiner*—Brenda A. Lamb

*Attorney, Agent, or Firm*—Wenderoth, Lind & Ponack, L.L.P.

[57] ABSTRACT

A method of producing watermark paper comprising forming a patterned wire by fixing and bonding a lace to a cloth wire for papermaking, fitting this patterned wire to a cylinder mould of a cylinder-vat machine or a dandy roll as a face wire, and making paper by using the cylinder mould or the dandy roll to which the patterned wire is fitted. This method can easily and economically produce watermark paper having a delicate and complicated lace pattern in excellent gradation.

6 Claims, 1 Drawing Sheet

METHOD OF PRODUCING WATERMARK PAPER

This application is a Continuation of now abandoned application, Ser. No. 07/721,598, filed as PCT/JP90/01602 published as WO91/09172 now abandoned.

TECHNICAL FIELD

This invention relates to a method of easily and economically producing watermark paper which is exquisite and has high gradation by utilizing a lace.

BACKGROUND ART

As production methods of watermark paper, there have heretofore been employed (a) a method which fits a pattern shape such as figures or characters on a face wire of a cylinder mould or a dandy roll, (b) a method which paints out the meshes of the face wire in a pattern with a resin or the like, and (c) a method which hammers the face wire itself into a corrugation pattern.

According to the methods (a) and (b), the meshes of the wire of the pattern portion are closed and the passage of fibrous materials through them is impeded. As a result, a wet web is not formed at that portion or even if it is formed, its thickness is reduced, so that a watermark pattern comes into view. If the size of the meshes of the face wire closed by the pattern shape is by far greater than a fiber length in this case, holes are formed in the wet web and renders a practical problem. Therefore, limitations must be imposed on the shape, size and distribution of the pattern shape or multi-layered papermaking must be carried out in order to prevent the formation of the holes. The operations of forming this pattern shape and fitting it to the wire and the operations of painting out the meshes of the wire in match with the pattern need an extremely high level of technique and skill and the production time necessary for such operations is extremely long, as well. The proposals described in Japanese Patent Publication Nos. 12202/1972, 21248/1974, 24483/1979 and 28486/1979 attempt to solve such problems and to easily produce a pattern shape or a wire cloth having the pattern shape by utilizing a photo-sensitive resin.

Since the method (c) hammers the pattern as the corrugation of the wire, the meshes of the wire are not closed. Therefore, the watermark pattern is generated due to the difference of drainage rate depending on the height of the corrugation of the wire, its depth, the angle of a slope, and so forth. In comparison with the methods (a) and (b), this method (c) is more excellent in so-called "gradation" which represents a delicate difference of density of the watermark pattern, has the smaller possibility of holes at which the fiber does not at all exist, and has a smaller limitation to the design of the watermark pattern. However, the production of the wire for the method (c) needs a higher level of technique and skill than the methods (a) and (b). Moreover, there is a problem that the corrugation pattern itself of the wire is likely to undergo deformation or breakage during the paper making operation.

The production methods of watermark paper described above exhibit the watermark pattern by forming low and high densities in the fiber distribution during the paper making process. Unlike these methods, a method which prints an arbitrary pattern by a transparentizing agent (Japanese Patent Publication No. 3802/1975) and a method using a resin which becomes transparent by hot press and then makes the pattern portion transparent by hot press to obtain a watermark-like pattern (Japanese Patent Laid-Open No. 275500/1986) have been proposed.

Japanese Patent Publication Nos. 7725/1972 and 12846/1974 propose a production method of watermark paper having a deep corrugation pattern by using a fourdrinier wire providing a pattern. This method however involves the problem that since the fourdrinier wire providing a pattern rotates while keeping in contact with a large number of rollers and receiving a hign tension, the expensive fourdrinier wire providing a pattern is worn out and its travelling stability is not satisfactory.

The various problems with the above-described conventional methods are summarized as follows.

1) An extremely high level of technique and skill are required for the conventional production method of the patterned wire and moreover, an extremely long period of time is necessary for the production thereof. Thus, there remain the problems that mass-producibility of watermark paper is impeded and the production cost is high.

2) According to the method (a) which fits the pattern mould such as figures and characters to the face wire and the method (b) which paints out the meshes of the wire in the pattern form, the design of the watermark pattern is limited in order to prevent the holes that are likely to occur when the meshes of the wire are closed. So-called "gradation" which represents a delicate difference of density of the watermark pattern is not sufficient, either.

3) The method (c) which hammers the pattern form in corrugation in the wire itself is superior to the methods (a) and (b) in the aspect of gradation, but this method involves the problem that the corrugated pattern itself is likely to undergo deformation and breakage during the papermaking process.

DISCLOSURE OF THE INVENTION

It is therefore an object of the present invention to provide a method which can solve the problems of the conventional methods described above, can freely watermark even a complicated pattern with high gradation and can moreover easily and economically produce watermark paper.

Namely, the method producing watermark paper in accordance with the present invention is characterized in that a lace is fixed and bonded to a wire cloth for papermaking to form a patterned wire, this patterned wire is fitted as a face wire to a cylinder mould of a cylinder-vat machine or a dandy roll, and papermaking is conducted by using the cylinder mould or the dandy roll to which the patterned wire is fitted.

The lace used in the present invention is a generic name of those products which are formed by yarn in a predetermined texture and express a through-hole-like pattern by the density of gaps between the yarns, and includes a fabric lace formed by making an embroidery on a base cloth such as a fabric, a knitted fabric and the like. (Refer to "Modern World Encyclopedia", Vol. 3, page 944 (1972), published by Kodansha.)

Materials of the yarn for producing the lace are not particularly limitative in the present invention and metal fibers such as bronze fibers or stainless steel fibers, synthetic fibers such as nylon or polyester and natural fibers such as cotton, hemp or wool can be used.

When the lace is integrally fixed and bonded to the wire cloth for papermaking, arbitrary means such as soldering, sewing, bonding by an adhesive and the like, can be selected depending on the materials of the lace.

Appearance of the pattern of watermark paper in the present invention is based on diversity of the lace texture such as the combination of the thickness of the yarns of the lace constituting the face wire, the density of gaps between the yarns, the variety of the thickness of the pattern portions formed by the degree of overlap of the yarns, and so forth. Accordingly, it is possible to obtain watermark paper having a complicated and exquisite pattern and excellent gradation that the conventional methods have not been able to obtain.

BEST MODE FOR CARRYING OUT THE INVENTION

Figure 1:
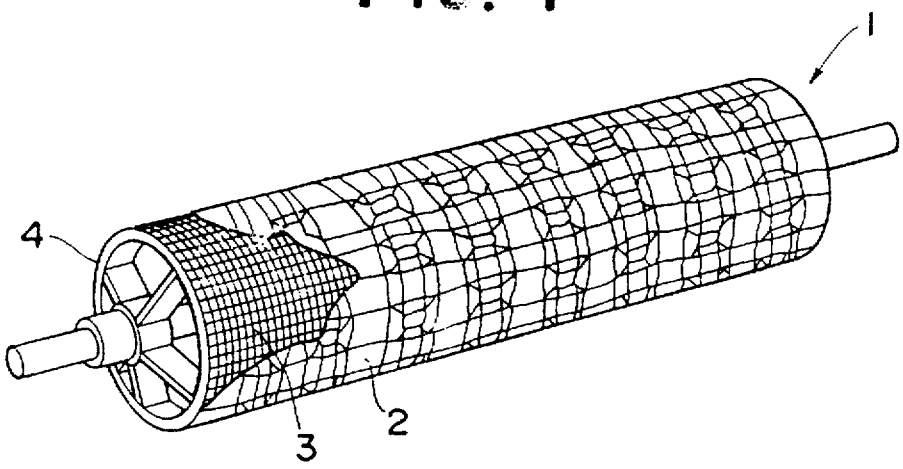
FIG. 1 is a perspective view of a dandy roll having a patterned wire fitted thereto which is used in the present invention.

FIG. 1 shows a dandy roll 1 which is used when the method of the present invention is practiced by a fourdrinier machine. This dandy roll 1 is produced by fitting a patterned wire, which is formed by fixing and bonding a lace 2 to a wire cloth 3 for papermaking, to a frame 4 of the dandy roll.

Figure 2:
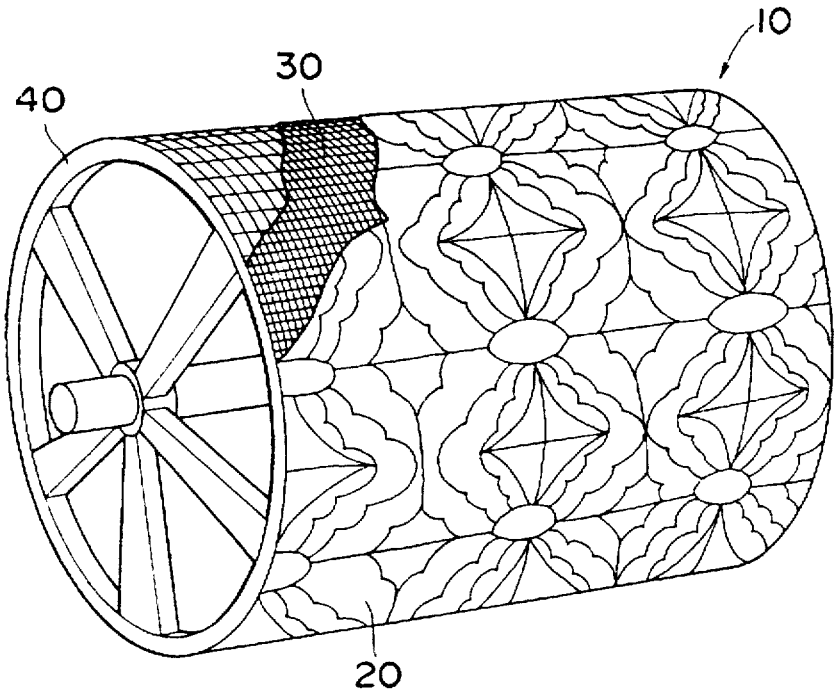
FIG. 2 is a perspective view of a cylinder mould for a cylinder-vat machine having a patterned wire fitted thereto which is used in the present invention.

FIG. 2 shows a cylinder mould 10 used when the method of the present invention is practiced by a cylinder-vat machine. This cylinder mould 10 is produced by fitting a patterned wire, which is formed by fitting and bonding a lace 20 to a wire cloth 30 for papermaking, to a frame 40 of the cylinder.

When the present invention is practiced, the dandy roll 1 shown in FIG. 1 is disposed and slidably rotated in the process in which wet web is formed on the wire part of the fourdrinier machine or the like, so as to execute paper making, and the resulting wet web is dried in a customary manner. In the case of the cylinder mould 10 for the cylinder-vat machine shown in FIG. 2, the cylinder mould 10 is disposed at a predetermined position inside a vat of the cylinder-vat machine and papermaking may be carried out in a customary manner. The cylinder-vat machine includes specific cylinder-vat machines such as a roto-former, a ultra-former, a Stevens former, and so forth.

In the present invention, as the lace for forming the patterned wire, a lace can be used as it is. However, in order to further improve gradation of the watermark pattern, it is possible to use those laces part of the mesh of which is painted out with a resin by printing, or those laces part of which is thickend with a resin.

EXAMPLE 1

A patterned wire was produced by fixing and bonding integrally a lace obtained by knitting polyester filaments and having a flower pattern to a 90-mesh wire cloth made of bronze by using an epoxy type adhesive (trade name "Araldite 106", a product of CIBA-GEIGY Co.), and this patterned wire was fitted as a face wire to a cylinder mould. Then, watermark paper having a basis weight of 120 g/m$^2$ was produced using paper stock having the following composition (per beater):

| | |
|---|---|
| NBKP | 150 Kg |
| LBKP | 390 Kg |
| (degree of beating: 400 cc CSF) | 7.2 Kg |
| rosin size | |

-continued

| | |
|---|---|
| ("SPN700", a trade name, a product of Arakawa Rinsan Kagaku Kabushiki Kaisha) dry strength agent | 20 Kg |
| ("POLYSTRON ST13", a trade name, a product of Misawa Ceramic Kabushiki Kaisha) starch | 3 Kg |
| ("AMYCOL", a trade name, a product of Nichiden Kagaku Kabushiki Kaisha) fixing agent | 30 Kg |
| (Aluminum sulfate) dyes (products of BAYER Co., Ltd.) | |
| LEVACELL FAST YELLOW GFN (L) | 0.02%* |
| LEVACELL FAST BLACK G | 0.002%* |

*Based on the plup

As a result, an exquisite and complicated lace pattern was watermarked and watermark paper having high gradation could be obtained.

EXAMPLE 2

Part of the pattern of a lace knitted by polyester filaments was painted out by screen printing using an epoxy resin ("Araldite 106", a tradename) and part thereof was further thickened with the resin.

The lace obtained in this manner was integrally fixed and bonded to a wire cloth made of bronze by an adhesive (the same epoxy resin as described above) to produce a patterned wire and this patterned wire was fitted as a face wire to a dandy roll. The dandy roll was placed on a wire part of a fourdrinier machine and was brought into rolling contact with wet web (dry basis weight: 110 g/m$^2$) having the same paper stock composition as in Example 1. Thereafter, paper was dried in a customary manner.

As a result, there could be obtained watermark paper having gradation due to a delicate watermark pattern formed by the lace pattern and a clear watermark pattern formed by the thickened resin portion and the paint-out portion by screen printing.

The effects obtained by the production method of watermark paper in accordance with the present invention described above can be summarized as follows.

1) In the production of the patterned wire for watermarking, fixing and bonding of the lace and the wire cloth are the main operations. Therefore, a high level of technique and skill, that have been necessary in the conventional method, are not necessary.

2) The production time of the patterned wire for watermarking inclusive of the lace production time can be reduced drastically by use of a mechanical knit lace. According to the expriments carried out by the inventors of the present invention, the production time of the patterned wire could be reduced to about 1/100 in comparison with the conventional method (a) which fits a pattern shape such as figures or characters.

3) The watermark pattern is exhibited by the texture of the yarns constituting a lace. Therefore, in comparison with the method which closes the meshes of the wire and has been employed mainly in the past to exhibit the watermark pattern, the method of the present invention is more excellent in the representation of gradation. Furthermore, since the possibility of occurrence of holes in the web due to the watermark pattern does not exist, there is no limitation to the design of the watermark pattern.

4) In the conventional method (c) which directly hammers the watermark pattern as corrugation of the wire, there is a great danger that the corrugation pattern gradually undergoes deformation or is worn out during the papermaking process. In this respect, the patterned wire used in the present invention which is obtained by fixing and bonding the lace and the wire cloth is more superior in the aspect of durability during the papermaking process.

5) The above explanation describes mainly the effects of the present invention in comparison with the conventional methods. Furthermore, the lace used in the present invention can be produced by converting the design of the lace into digital information by an electronic scanner or the like, and producing the lace by an automatic knitting or weaving machine. Therefore, even a lace having a complicated design can be produced within a short time.

6) Due to the effects described above, the present invention makes it possible to produce a variety of watermark paper having various designs in a limited quantity.

We claim:

1. A method of producing watermark paper comprising:

fixing a lace having a through-hole-like pattern obtained by knitting a synthetic fiber or a natural fiber or by making an embroidery on a base fabric, to an entire surface of a wire cloth for paper making by sewing or by bonding using an adhesive to form a patterned wire;

fitting said patterned wire as a face wire to an entire circumferential surface of a cylinder mold of a cylinder-vat machine or a dandy roll; and making said paper by using said cylinder mold or said dandy roll having said patterned wire fitted thereto.

2. The method of producing watermark paper according to claim 1, which uses a lace a part of the mesh of which is painted out in a pattern form with a resin.

3. A method of producing watermark paper according to claim 1 wherein said lace is made by making an embroidery on a base fabric.

4. The method according to claim 1 wherein the wire cloth is 90 mesh.

5. The method according to claim 3 wherein the wire cloth is 90 mesh.

6. The method according to claim 5, wherein said paper is produced by contacting said dandy roll with a wet web of a paper stock composition.

* * * * *